United States Patent [19]

Holt

[11] 3,967,356

[45] July 6, 1976

[54] INSERTION TOOL OPERABLE IN ACCORDANCE WITH A PREDETERMINED PROGRAM TO INSERT A PLURALITY OF CONDUCTORS IN INSULATION-PIERCING CONTACTS DISPOSED ON OPPOSITE SIDES OF AN ELECTRICAL CONNECTOR

[75] Inventor: Harley Raymond Holt, Hillside, Ill.

[73] Assignee: Bunker Ramo Corporation, Oak Brook, Ill.

[22] Filed: Dec. 11, 1974

[21] Appl. No.: 531,830

Related U.S. Application Data

[63] Continuation of Ser. No. 407,781, Oct. 19, 1973, abandoned.

[52] U.S. Cl. ..... 29/203 MW; 29/203 DT; 29/203 P; 29/628

[51] Int. Cl.[2] ..... H01R 43/04

[58] Field of Search. 29/203 MW, 203 DT, 203 HT, 29/203 H, 203 P, 203 D, 203 R, 628

[56] References Cited

UNITED STATES PATENTS

| | | | |
|---|---|---|---|
| 3,742,571 | 7/1973 | Brehm | 29/203 HT |
| 3,766,622 | 10/1973 | Brehm et al. | 29/203 MW |
| 3,845,535 | 11/1974 | Over | 29/203 MW |
| 3,866,293 | 2/1975 | Nijman | 29/203 MW |

*Primary Examiner*—Carl E. Hall
*Attorney, Agent, or Firm*—William Lohff; F. M. Arbuckle

[57] ABSTRACT

Apparatus for inserting a plurality of insulated conductors in respective insulation-piercing contacts of an electrical connector employs a programmer for controlling the movement of a carriage along the electrical connector and for controlling the insertion of a predetermined number of conductors on each side of the connector. The carriage is mounted for movement along the connector and is programmed for rest insertion positions whereat insertion tools are operated to insert and terminate the conductors. The programming and indexing mechanism includes a ratchet operated by the insertion mechanism to cock, via a torsion spring, a programming drum or cylinder which limits movement of the carriage to define positions along the connector. At these positions, the insertion mechanism is operated to insert a plurality of conductors, for example five conductors, on each side of the electrical connector.

40 Claims, 10 Drawing Figures

FIG. 6
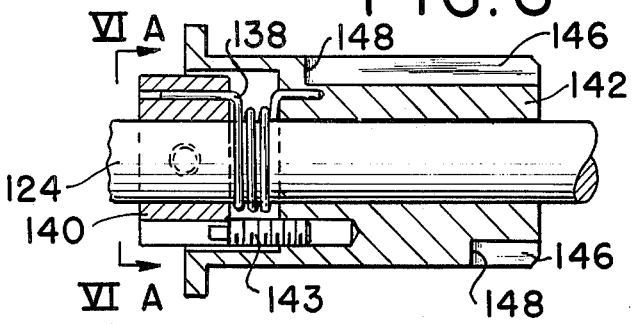
FIG. 6A
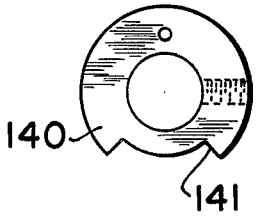
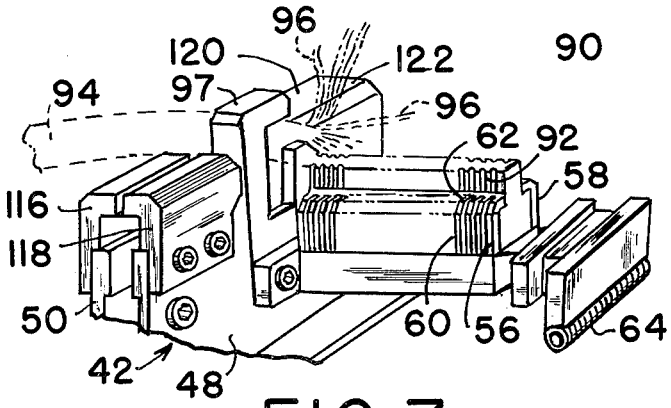
FIG. 7
FIG. 8
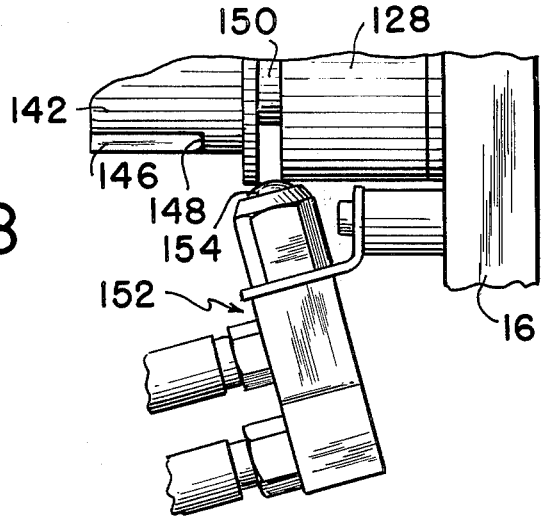

INSERTION TOOL OPERABLE IN ACCORDANCE WITH A PREDETERMINED PROGRAM TO INSERT A PLURALITY OF CONDUCTORS IN INSULATION-PIERCING CONTACTS DISPOSED ON OPPOSITE SIDES OF AN ELECTRICAL CONNECTOR

This is a continuation, of application Ser. No. 407,781 filed Oct. 19, 1973, now abandoned.

BACKGROUND OF THE INVENTION

1. Field of the Invention

This invention relates to conductor termination apparatus, and is more particularly concerned with the termination of conductors in insulation-piercing contacts of an electrical connector wherein a plurality of conductors, for example conductors of a similar color code, are inserted on each side of an electrical connector in accordance with a predetermined operational program.

2. Description of the Prior Art

The prior art recognizes numerous methods and apparatus for inserting insulated conductors into respective insulation-piercing contacts, including techniques for inserting insulated conductors into insulation-piercing contacts carried within said separate channels of an electrical connector.

Also, conductors have been terminated by means of a fluid controlled crimping process wherein conductors are fed to a station at which a contact, usually in the form of a terminal lug, is positioned about the connector and crimped to provide mechanical and electrical connection thereto.

The prior art also recognizes the utilization of mechanisms for aligning and inserting a plurality of strip conductors into electrical contacts, whereafter such conductors are soldered or crimped to the contacts.

SUMMARY OF THE INVENTION

The primary object of the present invention is to provide an apparatus whereby a plurality of conductors may be mechanically and electrically terminated in a corresponding plurality of insulation-piercing contacts in accordance with a predetermined sequence, such as may be dictated by conductor color coding.

Another object of the invention is to provide apparatus, as mentioned above, which in addition is almost completely automatic in operation, at least during a complete cycle operation which involves certain conductors of like identification.

An insertion apparatus, according to the present invention, comprises a base having a pair of upstanding plates carried thereon spaced forwardly and rearwardly with respect to the front end or operator's end of the apparatus. The forward upstanding member has a cable clamp mounted thereon for securing a cable so that the individual conductors thereof may be selected for insertion in an electrical connector in accordance with a predetermined schedule. The forward upstanding member is provided with a conductor support for mounting the conductor in a cantilevered manner extending forwardly of the forward support member. If, for example, five conductors of like identification are to be inserted on each side of the connector, an operator may select the conductors and dress the same two positions located immediately adjacent and parallel to the parallel channels of the connector which include therein respective insulation-piercing contacts.

The forward upstanding support member includes a pair of longitudinally disposed bearings each having disposed therein a carriage rod which supports a carriage frame which is designed to span the cantilever connector support. If five conductors are to be inserted on each side of the connector at one time, the carriage is indexed to have a total movement of five channel spaces during each sequential insertion operation. The carriage carries a pair of pivotally mounted insertion levers each of which mounts a multiple element insertion tool for performing the insertion operations at each rest position of the carriage.

The insertion mechanism includes a pair of pivotally mounted insertion levers carried by the carriage frame and having a cylinder and extensible rod carried in a pivotal suspended relationship to effect equalization of forces across the connector. In the particular embodiment disclosed, the cylinder for operating the insertion levers, and a cylinder for moving the carriage back and forth, are included in a fluid control circuit, in particular a pneumatic control circuit which is operable to effect carriage movement and insertion operations.

An indexing mechanism is also included for defining carriage movements two points which are spaced at least the spacing of the connector channels, or multiples thereof.

BRIEF DESCRIPTION OF THE DRAWINGS

Other objects, features and advantages of the invention, its organization, construction and operation, will be best understood from the following detailed description taken in conjunction with the accompanying drawings, on which:

FIG. 6 is a sectional view taken generally along the line VI—VI of FIG. 2, with FIG. 6A showing a plan view of a coupling member;

FIG. 7 is a detail view of a cable clamp and connector support for use with the apparatus illustrated in the previous figures;

FIG. 8 is an elevational view of a portion of the apparatus of FIG. 1 as viewed from the opposite side and specifically showing a valve actuating mechanism.

DESCRIPTION OF THE PREFERRED EMBODIMENT

Figure 1:
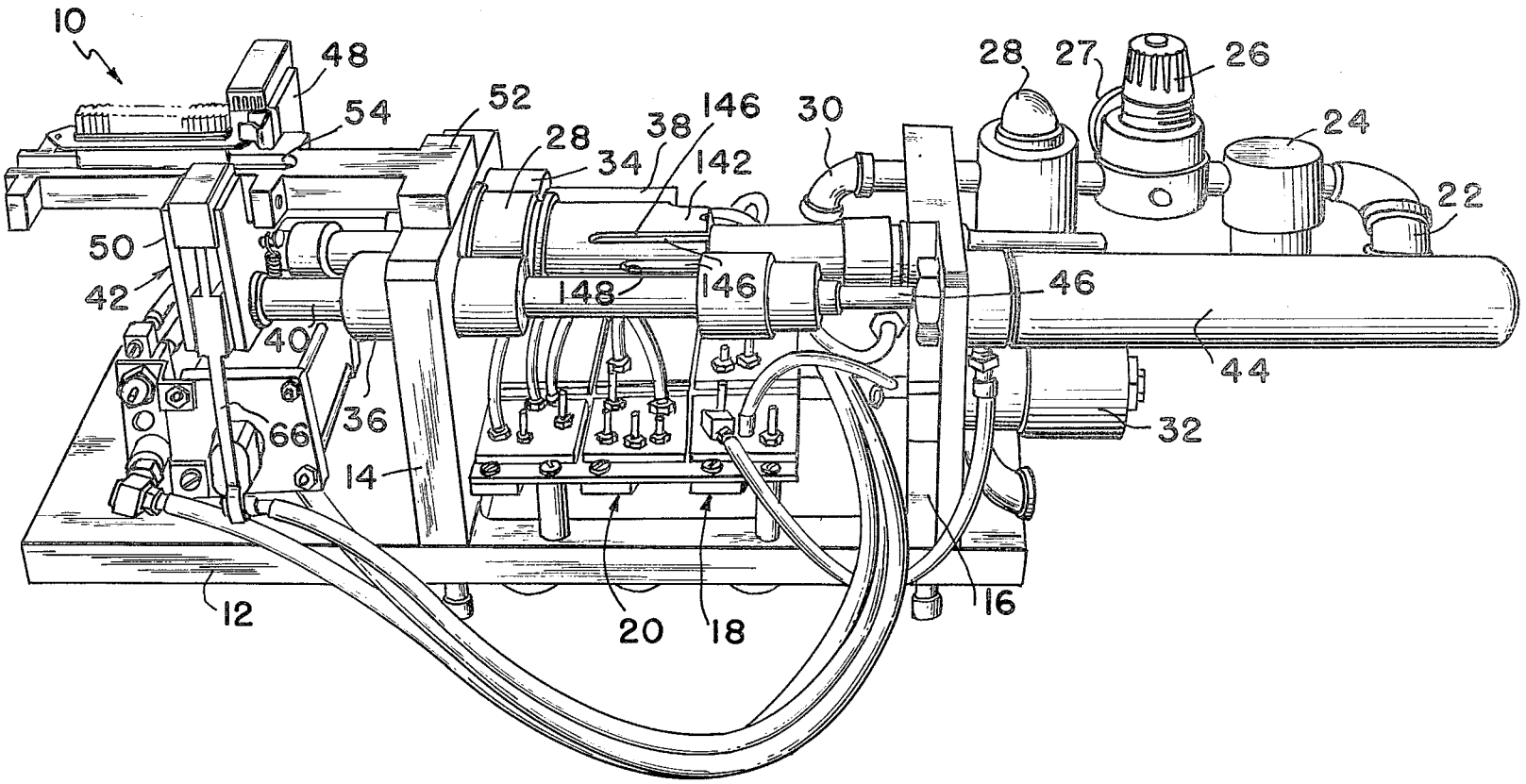
FIG. 1 is a pictorial representation of a pneumatically actuated and controlled termination apparatus constructed in accordance with the principles of the invention.
Figure 2:
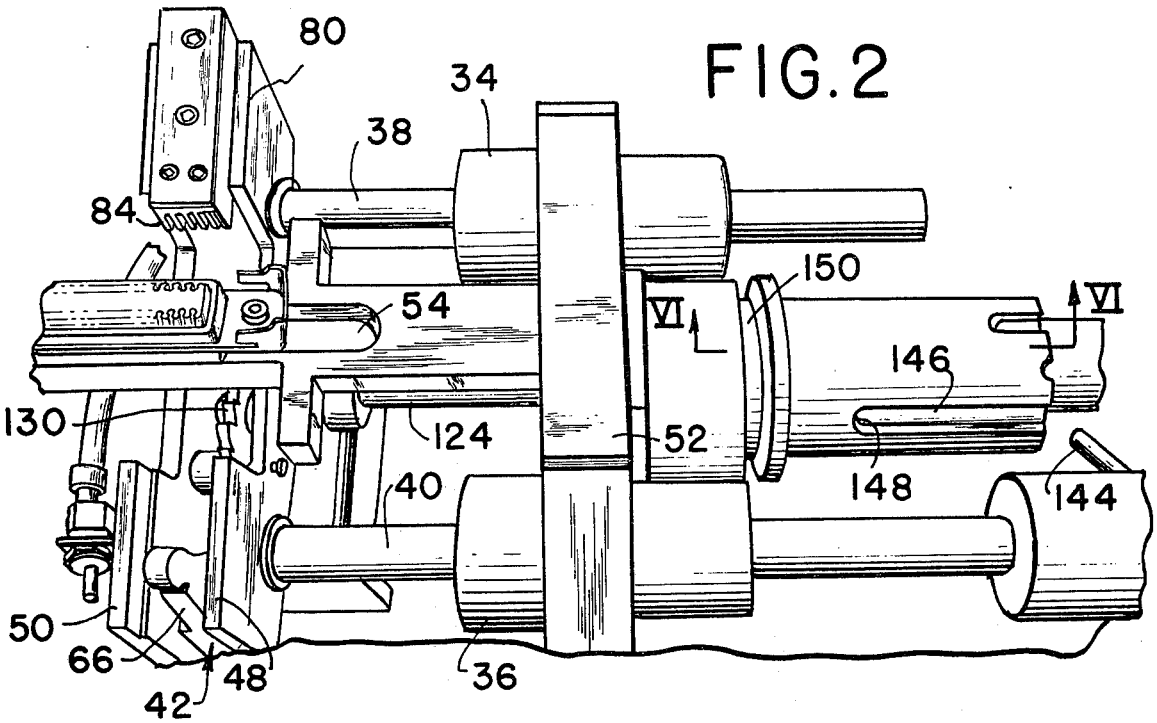
FIG. 2 is a detailed view of a portion of the apparatus of FIG. 1 shown generally from the top.
Figure 3:
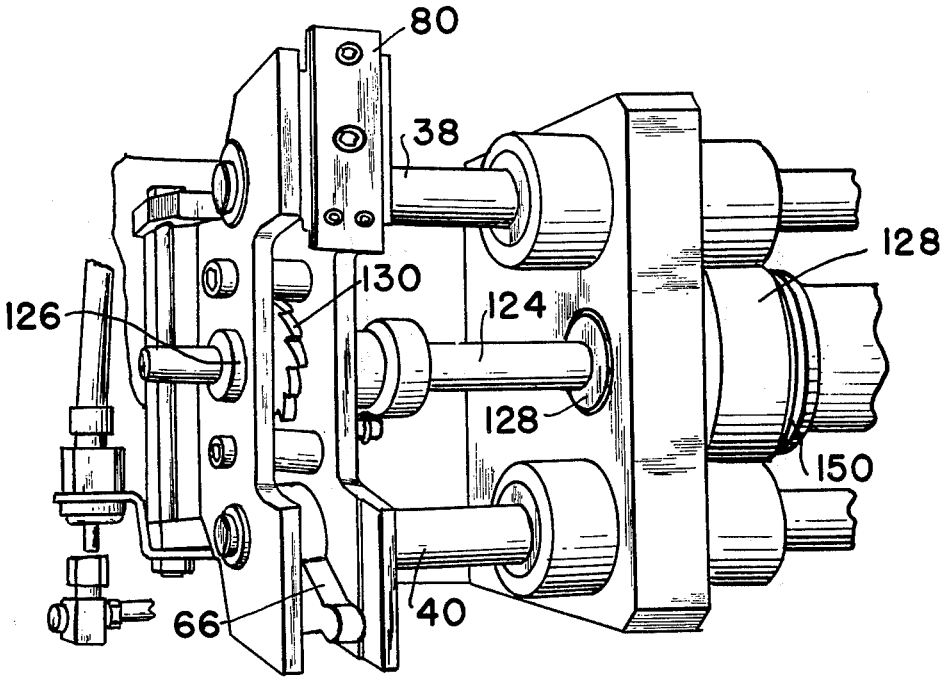
FIG. 3 is another detail view of a portion of the apparatus of FIG. 1 shown generally from the top.

Referring to FIGS. 1–4, terminating apparatus is generally illustrated at 10 as comprising a base plate 12, a front support member 14 carried upright on the base plate 12, a rear support member 16 carried upright on the base plate 12, an aperture 18 in the base plate 12, and a plurality of control valves 20 mounted on the base plate 12 and extending through the aperture 18.

An air inlet 22 is adapted to supply shop air to a filter 24 and through a regulator 26 having an indicating meter 27 to a lubricator 28 and an air outlet 30. The air outlet 30 is connected to the valves 20 by way of a solenoid operated valve 32 mounted on the rear support member 16. The air supply is connected to the valves 20 by way of a plurality of air lines as will be readily apparent from the later description dealing with FIG. 9.

The front support member 14 mounts a pair of longitudinal bearings 34 and 36 which support respective shafts 38 and 40 for movement longitudinally of the apparatus 10. A frame 42 is mounted at the forward ends of the shafts 38 and 40 to form a carriage which is moved longitudinally of the apparatus 10 by a carriage air cylinder 44 mounted on the rear support member 16 and having an extensible member 46 which extends through the member 16 and is connected to the shaft 40. As will be explained below, the longitudinal movement of the carriage is performed in accordance with a predetermined sequential program.

The carriage frame 42 includes a pair of spaced plates 48 and 50 which are generally U-shaped so as to span and travel on each side of a cantilever mounted connector support 52 having a connector receiving slot 54 therein.

Referring to FIG. 7 for a moment, the cantilever 52 carries a pair of conductor spacing and dressing combs 56 and 58 on each side thereof having a plurality of conductor receiving comb slots 60 each having a sharp rear edge 62 which functions as a conductor cutting edge during conductor insertion. The distal end of the cantilever conductor support 52 carries a waste spring 64 for holding the free ends of the conductors as a housekeeping feature to prevent cluttering up of the work area.

Figure 4:
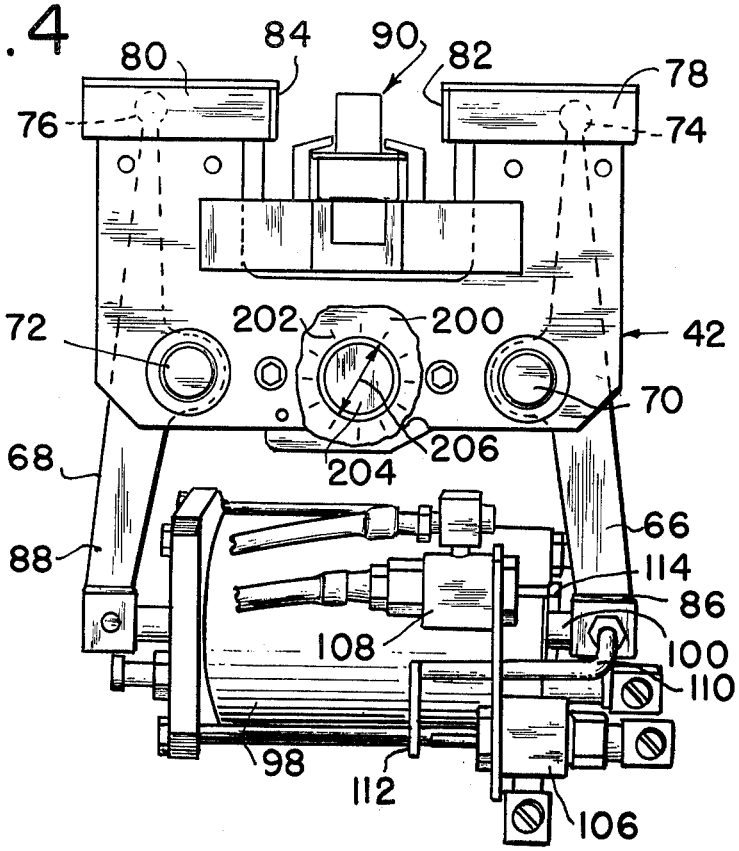
FIG. 4 is a front view of a portion of the apparatus of FIG. 1.
Figure 5:
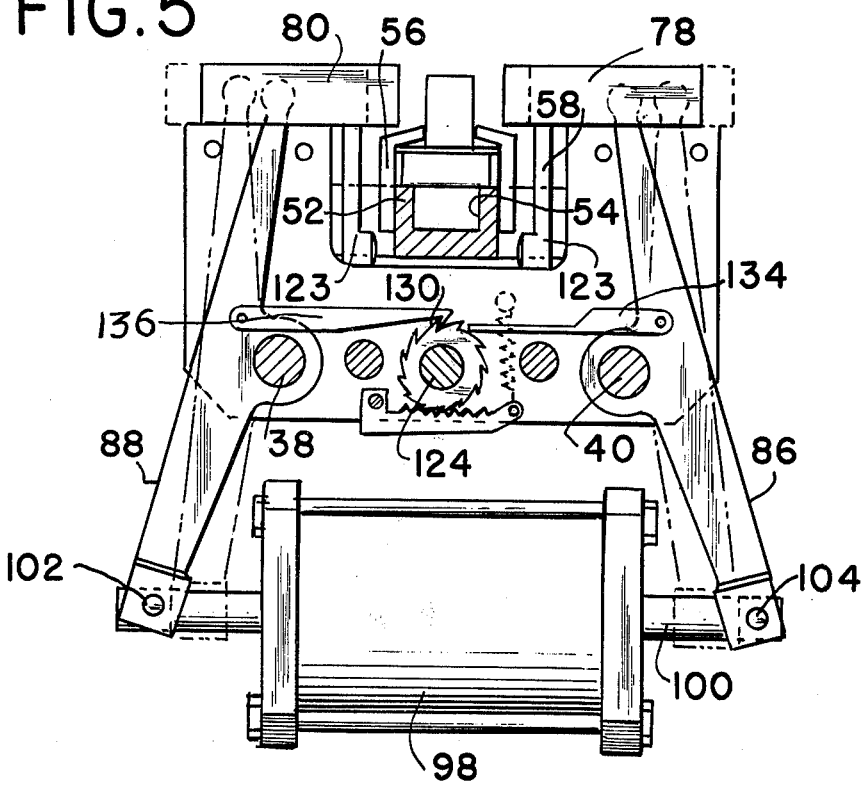
FIG. 5 is a front view of the apparatus illustrated in FIG. 4 with a plate removed to better show a ratchet arrangement.

Turning now to FIG. 4, the carriage frame 42 has a pair of insertion levers 66 and 68 pivotally mounted between the plates 48 and 50 at the pivots 70 and 72, which as shown in the drawing may advantageously include the carriage shafts 38 and 40. The levers 66 and 68 have respective upper ends which terminate in ball type pivots 74 and 76 for pivotally mounting a pair of insertion heads 78 and 80 which include insertion punches 82 and 84, respectively. The number of insertion punches may vary from one up to any desired number. For example, a 50 conductor cable may have 10 conductors of the same basic color code, of which 5 conductors are to be terminated on each side of a connector. In this case, the insertion heads would each include 5 punches. As will become apparent from the description of the indexing mechanism, however, any number of punches and longitudinal movement in any desired sequence may be effected in accordance with a predetermined program as dictated by a wiring schedule.

The insertion levers 66 and 68 have respective lower ends 86 and 88 which are pivotally connected to an insertion air cylinder 98 and its extensible piston rod 100. Extension of the rod 100 effects a parting of the lower ends, and thus a closing of the upper ends of the insertion levers 66 and 68 to cause the insertion heads 78 and 80 to move into a connector carried on the cantilevered connector support. As shown in the drawings, a connector 90 is mounted in the slot 54 and has a plurality of parallel vertically oriented channels 92. Each of the channels 92 has therein an insulation-piercing contact which mechanically and electrically terminates the respective conductors 96 of a cable 94 which is gripped by a cable clamp 97 mounted on the front support member 14. With a connector so mounted, the channels 92, the comb slots 60 and the insertion punches 82 and 84 are in alignment, and as the insertion heads are moved into engagement with the connector an equalization of insertion forces across the connector is effected due to the free pivotal suspension of the cylinder 98 and its rod 100 at the pivotal connections 102 and 104, in conjunction with the pivotal connections 70 and 72 of the levers and 74, 76 of the insertion heads.

As can be seen in FIG. 4, a pair of valves 106 and 108 are mounted for movement with the cylinder 98 and a valve actuating lever 110 having a pair of actuating members 112 and 114 is carried by the insertion lever 68 for effecting control operations upon initiation and termination of an insertion operation. These valves, and their specific functions, will become apparent from the description of operation offered in connection with FIG. 9.

The spaced plates 48 and 50 of the carriage frame 42 each carry a pair of insertion head guide members 116–122 for guiding the insertion heads in a horizontal line toward the connector. The pivotal connection of the insertion levers 66 and 68, constituted by the ball type pivots 74 and 76, together with the guiding action of the guide members 116—122, converts the arcuate movement of the levers into rectilinear movement of the insertion heads toward and away from the support connector. As the insertion heads extend beyond the guide members, particularly as the pivotal connections of the insertion heads extend beyond the guide members, the insertion heads may have a tendency to ride up on the conductors, rather than cooperate with the cutting edges 62 of the combs to sever the conductors. This action is more pronounced as larger numbers of conductors are inserted at the same time. Therefore, each insertion head is provided with a depending L-shaped member 123 for engaging the lower edge of the respective combs, or the lower surface of the cantilever support 52, to maintain a straight line horizontal movement of the insertion heads.

During a cycle of operation of the termination apparatus 10, a programming and indexing mechanism is provided for controlling the movement of the carriage from one insertion position to the next. In the particular embodiment illustrated in the drawings, particularly in FIGS. 2–6, a ratchet shaft 124 is mounted for rotation in a pair of bearings 126 and 128 and carries a ratchet 130 between the carriage frame plates 48 and 50. The ratchet 130 has a holding pawl carried by the frame 42 and biased to prevent movement of the ratchet in one direction. The insertion lever 66 carries an actuating pawl 134 and the insertion lever 68 carries an actuating pawl 136 in the form of a hook for rotating the ratchet 130. As the levers are operated to move toward each, the pawl 134 engages and initiates rotation of the ratchet 130 and as the levers move apart upon completion of insertion, the actuating pawl 136 pulls the ratchet 130 an additional amount whereupon the holding pawl 132 engages to prevent the ratchet from returning under the influence of a torsion spring 138 connected to the ratchet shaft 124.

The torsion spring 138 couples the shaft 124 to a drum 142 by means of a coupling member 140 having an arcuate limit stop mechanism defined by the arcuate slot 141 in the coupling 140 and a pin 143 carried by the drum 142.

The drum 142 is rotatably carried on the shaft 124 and includes a plurality of circumferentially spaced axially extending proram slots 146 each open to the rear end of the drum 142 and each having a closed end 148 which defines limits of carriage movement and the insertion positions assumed by the carriage. The carriage shaft 40 has a pin 144 extending therefrom for movement through a slot 146 to engage the closed slot end 148. The drum 142 is mounted for limited axial movement as defined by a space 150 between the drum 142 and the bearing 128. In FIG. 8, a valve 152 is carried by the front support member 14 and includes a ball-type actuator 154 which is spring loaded for extension, at least partially, into the space 150. As the drum 142 is brought into contact with the bearing 128, the valve 152 is operated to indicate completion of carriage movement toward the operator position and to effect further automatic control of an insertion operation which will be explained in detail below.

Up to this point, a termination apparatus has been described in which a carriage is movable back and forth along a connector support to predetermined positions at which conductor insertion operations are performed. The carriage carries a pair of pivotally mounted insertion levers, each of which has an insertion head at one end thereof and a pivotal connection to an insertion air cylinder at the other end thereof. The insertion mechanism is freely pivotal with the air cylinder suspended in a manner which provides for equalization of insertion forces across a connector. A programming and indexing mechanism includes a rotatable drum having a plurality of circumferentially spaced slots therein of different lengths for defining carriage rest positions for performing the insertion operations and is indexed from one position to the next by means of a ratchet mechanism to store energy in a torsion spring, the energy being released upon rearward movement of the carriage to disengage a pin from a program slot whereupon the drum is rotated to bring the next slot into alignment with the pin.

Figure 9:
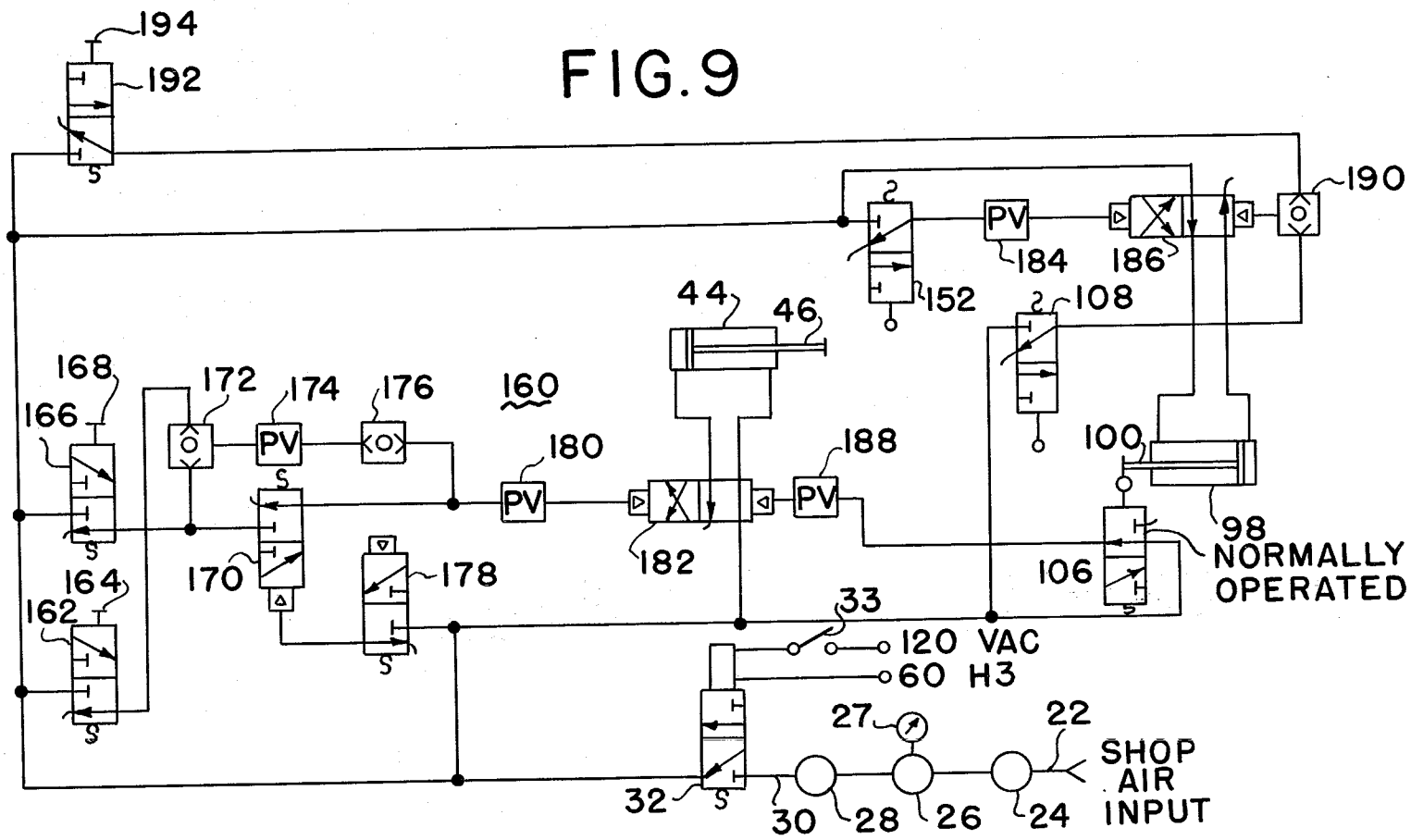
FIG. 9 is a schematic fluid circuit diagram of the pneumatic control apparatus for controlling the terminating apparatus illustrated in FIGS. 1–8.

The control of carriage movement and insertion operations will now be explained with reference to FIG. 9. In FIG. 9, the shop air input 22, the air filter 24, the pressure regulator 26 and operating meter 27, the air lubricator 28 and the air output 30 have been schematically illustrated as connected to a solenoid control valve 32 having an energizing switch 33 connected to a commercial electrical supply, sequence as 120 VAC,60 Hz. The solenoid valve 32 permits disconnection of the air supply to the remainder of the circuit and provides that the circuit is set to a predetermined point in the operating cycle when the apparatus is turned on.

The control circuit 160 could, of course, be a hydraulic circuit, but has been illustrated herein as a pneumatic circuit including a pair of simultaneously operated manual valves 162 and 166 having hand operated plungers 164 and 168, respectively. Each of the valves illustrated, with the exception of the cylinder control valves, is spring loaded, as indicated by the S symbol opposite the actuating end thereof. Simultaneous actuation of the valves 162 and 166 provides air to charge a valve 170 and by way of a shuttle valve 172, a pulse valve 174 and a shuttle valve 176 provides an operating air pulse to a valve 178 which is already charged from the operated valve 32. Operation of the valve 178 provides an operating air supply to the pilot of the valve 170 to operate that valve. The valve 170 provides air to a pulse valve 180 which pulses a valve 182 to reverse that valve and cause the carriage air cylinder 44 to extend its rod 46. This movement of the carriage brings the pin 149 into a program slot 146, into engagement with the slot end 148 to close the space 150 depressing the ball actuator 154 to actuate the valve 152 indicating that the carriage has moved to an insertion position.

Actuation of the valve 152 causes connection of the air supply to a pulse valve 184 to effect an air pulse for reversing a valve 186. Reversal of the valve 186 causes the cylinder 98 to extend its rod 100 to release the normally operated valve 106 as the insertion levers are moved apart at their lower ends. Movement of the rod 100 to its fully extended position effects operation of the valve 108 by way of the valve actuating lever 110 and the actuating member 112. Operation of the valve 108 supplies air by way of a shuttle valve 190 to again reverse the valve 186 and retract the rod 100.

As the rod 100 moves back into the cylinder 98, the actuating member 112 disengages the valve 108 and upon completion of retraction the actuating member 114 engages and operates the valve 106 to supply air to a pulse valve 188 to reverse the valve 182 and cause retraction of the rod 46 into the cylinder 44.

As the insertion levers were operated, the ratchet 130 was rotated and held to store energy in the torsion spring 138. Upon retraction of the rod 46 and movement of the carriage rearwardly a sufficient amount for the pin 149 to clear the program slot 146, the drum 142 is rotated by the torsion spring to the next position.

A manually operated reset circuit is also provided to cause retraction of the rod 100 and disengagement of the insertion heads from the connector. This manual reset circuit comprises a valve 192 having an operatingc plunger 194 and connected to the shuttle valve 190. Depression of the plunger 194 causes the valve 192 to connect an air supply through the shuttle valve 190 to reverse the valve 186. This initiate of operation following reversal of the valve 186 is the same as described above.

Any suitable control valves may be employed for controlling the operation of the termination apparatus. The particular valves utilized in an operating embodiment of the invention were obtained from Clippard Module Controls, 7390 Colerain Road, Cincinnati, Ohio.

In the overall operation of the terminating apparatus, an operator first clamps a cable 94 into the cable clamp 97 and dresses the individual conductors 96 into the comb slots, and possibly into the connector if the connector is provided with dressing notches which communicate with the channels 92. The conductors may be dressed in groups, or the entire cable may be dressed, and the free ends inserted into the waste spring 64. The ratchet mechanism may be constructed for rotation in either direction and insertion from front to back, or back to front, may be provided as desired. For each insertion operation, the operator depresses the plungers 164 and 168 to initiate the automatic insertion sequence for each group of conductors. Programming of the drum 142 in accordance with a desired number of conductor insertions for each cycle determines the carriage position at the beginning of the next cycle.

The termination apparatus may be manually indexed to any desired position. In FIG. 4, for example, a portion of a cover plate 200 is illustrated as carrying an indicia of spaced marks 202. Diametrically opposed marks identify the same carriage position, as indicated by the double headed arrow 206 carried by a knob 204 mounted on the ratchet shaft 124. The knob 204; may be manually rotated to select a desired carriage position, for example, in accordance with a particular conductor color code, by manually positioning the double headed arrow 206 carried by the knob 204 with respect to the indicia 202. Upon retraction of the extensible rod 46 and disengagement of the pin 144 from a drum slot 146, the drum 142 rotates to the desired position and the next insertion cycle occurs at the selected position.

Although the invention has been described by reference to a specific illustrative embodiment thereof, many changes and modifications of the invention may become apparent to those skilled in the art without departing from the spirit and scope of the invention. It is therefore intended that the patent warranted hereon include all such changes and modifications as may reasonably and properly be included within the scope of this contribution to the art.

What is claimed is:

1. Apparatus for terminating a plurality of free-ended insulated conductors in respective insulation-piercing contact portions arranged in separate rows on each side of an electrical connector, said apparatus comprising:

connector support means for supporting the connector with the contact portions oriented to receive respective conductors disposed immediately adjacent and parallel thereto;

a plurality of insertion levers each including an upper and a lower end and each pivotally mounted in alignment with each other on opposite sides of said connector support means;

a pair of conductor insertion tools each mounted at said upper end of a respective insertion lever and each including at least one insertion blade for engaging and pressing a conductor into an insulation-piercing contact portion;

a circuit including a device having extensible means connected to said lower ends of said insertion levers, first switch means operable to cause said extensible means of said device to pivot the upper ends of said insertion levers toward each other to effect conductor insertion, and second switch means operated by one of said levers upon completion of insertion to reverse said device and withdraw said extensible means; and insertion lever carriage means mounted for movement relative said connector support means between points spaced a distance of at least the spacing between the parallel content portions of a row.

2. Apparatus for terminating a plurality of free-ended insulated conductors in respective insulation-piercing contact portions arranged in separate rows on each side of an electrical connector, said apparatus comprising: a base;

connector support means mounted on said base for supporting the connector with the contact portions oriented to receive respective conductors disposed immediately adjacent and parallel thereto;

a carriage mounted on said base for movement along said connector support means;

a pair of conductor insertion means pivotally mounted on said carriage on opposite sides of said connector support means, each insertion means including at least one insertion member mounted facing the other like member for engaging and forcing respective conductors into insulation-piercing contact portions on opposite sides of the connector;

indexing means coupled to said carriage for defining predetermined distances between insertion positions equal to at least the contact portion spacing, said indexing means coupled to and operated by one of said insertion means; and a fluid control circuit for controlling movement of said carriage and pivoting of said insertion means, including first and second fluid operated cylinders having respective first and second extensible means, said first extensible means connected to said insertion means, said second extensible means connected to said carriage, manually operated first switch means connected in circuit with said first cylinder and operated to effect conductor insertion, second switch means connected to said first cylinder and operated by one of said insertion means to reverse the cylinder circuit connections and effect withdrawal of said insertion means, and third switch means connected in circuit with said second cylinder and operated by one of said insertion means upon withdrawal thereof to effect movement of said carriage from said one insertion position to another.

3. The apparatus of claim 2, comprising:

an upstanding member supported by said base;

said carriage means carried by said upstanding member for movement along said connector support means; and said second cylinder mounted on said upstanding member.

4. The apparatus of claim 2, comprising:

a carriage support member extending from said base and including a bore therethrough; and said carriage including a rod slidably mounted in said bore and connected to said second extensible means, and a frame connected to said rod and mounting said conductor insertion means.

5. The apparatus of claim 2, comprising:

a pair of spaced-apart support members extending from said base, one of said support members including a pair of bores therein and the other support member including a bore therein aligned with one of the bores of said one support member; and said carriage including a pair of rods slidably mounted in said bores of said one support member, said second cylinder mounted on said other support member with said second extensible means extending through said bore of said second support member and connected to said rod extending through the bore aligned therewith, and a frame connected to said rods and mounting said conductor insertion means.

6. The apparatus of claim 2, wherein said first cylinder is mounted on said carriage for movement therewith.

7. The apparatus of claim 2, wherein said first cylinder is mounted on said carriage with said first extensible means extendible transversely of the direction of movement of said carriage.

8. The apparatus of claim 2, wherein said first cylinder and said first extensible means are pivotally connected between said pair of conductor insertion means to support said first cylinder in a freely swinging relationship to effect equalization of insertion forces on each side of the connector.

9. The apparatus of claim 2, comprising:

a support member extending from said base slidably supporting said carriage and carrying said connector support means.

10. The apparatus of claim 9, wherein said connector support means includes a cantilever mounted member having a slot therein for receiving and aligning the connector for the insertion operations.

11. The apparatus of claim 2, wherein said indexing means comprises:

a rotatable drum having an axis of rotation extending in the direction of carriage movement and first stop means spaced circumferentially and axially of said drum;

second stop means connected to said carriage for engaging said first stop means to limit movement of said carriage and define said insertion positions; and a ratchet coupled to said drum and operated by at least one of said insertion means.

12. The apparatus of claim 11, wherein said plurality of first stop means includes a plurality of slots in said drum each opening through one end of said drum and extending different distances to respective closed ends along the surface of said drum, and said second stop means includes a projection to be received by said slots to engage the closed ends thereof and limit carriage movement.

13. The apparatus of claim 11, comprising:

a torsion spring connecting said ratchet to said drum; and wherein said first and second stop means are engageable to prevent rotation of said drum by said spring until movement of said carriage effects disengagement of said first and second stop means.

14. The apparatus of claim 11, wherein each of said insertion means includes a pawl extending therefrom to engage said ratchet, said one of said pawls effective to initiate rotation of said ratchet in a predetermined direction and the other of said pawls effective to complete rotation of said ratchet.

15. The apparatus of claim 13, comprising:

said torsion spring connecting said ratchet and said drum, said torsion spring twisted sufficiently to rotate said drum only by the cooperative action of both of said pawls.

16. The apparatus of claim 14, wherein:

said first extensible means is pivotally connected between said pair of conductor insertion means to support said first cylinder in a freely swinging relationship to effect equalization of insertion forces on each side of the connector;

and comprising a torsion spring connecting said ratchet and said drum, said spring twisted sufficiently to rotate said drum only by the cooperative action of both of said pawls, said second switch and its operating insertion means mounted relative each other to effect operation of said second switch only upon equalization of insertion forces.

17. Apparatus for terminating a plurality of free-ended insulated conductors in respective insulation-piercing contact portions arranged in separate rows on each side of an electrical connector, said apparatus comprising: a base;

front and rear parallel support members extending from said base, said support members having a plurality of bores therethrough;

a connector support mounted on and extending forwardly of said front support member including a connector alignment slot for receiving the electrical connector with the contact portions thereof oriented to receive respective conductors disposed immediately adjacent and parallel thereto;

a carriage mounted for movement along said connector support including a pair of rods slidably mounted in respective ones of the bores of said front support member and a carriage frame mounted at the forward ends of said rods and spanning said connector support;

a carriage cylinder mounted on said rear support member including an extensible member extending through one of said bores of said rear support member and connected to one of said shafts for moving said carriage;

a pair of conductor insertion levers each having an upper end and a lower end and pivotally connected to said carriage frame between said upper and lower ends on opposite sides of said connector support;

a pair of insertion means mounted on respective ones of said upper ends and each including a plurality of insertion members for engaging and forcing respective conductors into the insulation-piercing contact portions;

insertion cylinder means including an extensible member, said insertion cylinder means and said extensible member pivotally connected to respective ones of said lower ends of said insertion levers to pivotally suspend said insertion cylinder means and provide for equalization of insertion forces across the connector;

a first shaft mounted for rotation in said frame;

a ratchet carried by said first shaft and operated by said insertion levers;

a torsion spring connected to said first shaft for storing energy upon rotation of said ratchet;

a second shaft rotatably mounted in one of said bores in said rear support member;

an indexing cylinder mounted on said second shaft, said cylinder including a plurality of circumferentially spaced slots opening to and extending from the rear end of said cylinder to close slot ends at different points along said cylinder, said cylinder coupled to said torsion spring for rotation upon release of the energy stored in said spring;

a projection extending from one of said carriage rods for receipt by said cylinder slots to prevent rotation of said cylinder and to limit the movement of said carriage to define points of carriage rest for conductor insertion; and a fluid control circuit connected to said carriage and insertion cylinders and operable to move said carriage forward and rearward and to pivot said insertion levers in accordance with a predetermined program.

18. Apparatus for terminating a plurality of insulated conductors in respective insulation-piercing contact portions disposed in separate rows on each side of an electrical connector, said apparatus comprising:

connector support means for supporting the connector with the channels oriented to receive respective conductors disposed immediately adjacent and parallel thereto, including a support member and a cantilever member extending from said support member;

carriage means mounted for movement relative said cantilever support member, including a frame spanning said cantilever member;

a pair of insertion levers each including an upper end and a lower end and each pivotally mounted on said frame on opposite sides of said cantilever member in alignment with each other;

a pair of conductor insertion tools each mounted at said upper end of a respective insertion lever and each including at least one insertion blade for engaging and pressing a conductor into an insulation-piercing contact portion; and a control circuit including a device having extensible means connected to said lower ends of said insertion levers, first switch means operable to cause said extensible means of said device to pivot the upper ends of said insertion levers toward each other to effect conductor insertion, and second switch means operated by one of said levers upon completion of insertion to reverse said device and withdraw said extensible means.

19. The apparatus of claim 18, comprising a pair of spaced combs mounted on said cantilever member for receiving the connector therebetween, said combs having teeth defining slots aligned with the channels of the connector for receiving the conductors therein.

20. The apparatus of claim 19, wherein each of said slots includes a cutting edge and each of said insertion blades includes a cutting edge cooperable with said slot cutting edges to cut the respective conductors to predetermined lengths immediately prior to insertion.

21. The apparatus of claim 20, comprising a pair of L-shaped structures depending from respective ones of said insertion tools to engage the underside of said cantilever member and prevent said insertion tools from riding up on and not cutting the conductors.

22. The apparatus of claim 20, comprising means carried by each of said insertion tools for engaging said conductor support means to ensure conductor cutting by maintaining the cutting edges of said blades in a cooperable cutting relationship with the cutting edges of said slots.

23. The apparatus of claim 19, wherein each of said insertion tools is pivotally mounted to the respective insertion lever, and comprising a pair of insertion tool guides mounted on said frame for guiding the respective cutting tools horizontally as said cutting tools are pivotally moved toward the connector.

24. The apparatus of claim 23, wherein said guides are spaced from the support position of the connector at the nearest point to the support position, the pivotal connections of said insertion tools move toward each other and extend so as to be nearer the conductor support position than said nearest points whereat forces other than horizontally through the pivotal connections may effect undesired pivoting of said insertion tools, and comprising means carried by each of said insertion tools for engaging said connector support means to prevent undesired pivoting and maintain the desired horizontal movement of said insertion tools.

25. Apparatus for terminating a plurality of insulated conductors in respective insulation-piercing contact portions disposed in separate rows on each side of an electrical connector, said apparatus comprising:

connector support means for supporting the connector with the channels oriented to receive respective conductors disposed immediately adjacent and parallel thereto:

a plurality of insertion levers each including an upper and a lower end and each pivotally mounted in alignment with each other on opposite sides of said connector support means;

a pair of conductor insertion tools each mounted at said upper ends of respective insertion levers and each including at least one insertion blade for engaging and pressing a conductor into an insulation-piercing contact portion;

an automatic control circuit including first means connected between said lower ends of said insertion levers for pivoting said insertion levers to effect conductor insertion and second means operable in response to at least one of said levers being pivoted upon completion of insertion to reverse the operation of said first means and pivot said levers in the opposite direction; and insertion lever carriage means mounted for movement relative said connector support means between points spaced a distance of at least the spacing between the insulation-piercing contact portions of a row.

26. The apparatus of claim 25 comprising:

switch means mounted for operation by said carriage means at said spaced points to effect operation of said first means to cause insertion of said conductors.

27. The apparatus of claim 25 wherein the plurality of insulated conductors is in the form of a cable, and wherein said apparatus comprises:

a cable clamp mounted on said connector support means for releasable engagement with the cable to support the cable during insertion operations.

28. Apparatus for terminating a plurality of insulated conductors in respective insulation-piercing contact portions supported on at least one side of an electrical connector, said apparatus comprising:

connector support means for supporting the connector with the channels oriented to receive respective conductors disposed immediately adjacent and parallel thereto;

a carriage mounted for movement relative said connector support means between points spaced a distance of at least the spacing between the insulation-piercing contact portions;

an insertion tool pivotally carried by said carriage means for movement transverse to the relative movement of said carriage means and including at least one insertion blade for engaging and pressing a conductor into an insulation-piercing contact; and an insertion programmer operable to effect relative movement to said spaced points between said carriage means and said support means and pivotal movement of said insertion tool in accordance with a predetermined sequence of operation.

29. Apparatus for terminating a plurality of insulated conductors, according to claim 28, wherein said insertion programmer comprises:

a fluid control circuit including an indexing cylinder connected to said carriage and operated by said fluid control circuit to move said carriage to said spaced points and an insertion cylinder connected to said insertion tool for causing the transverse movement of said insertion tool in accordance with the predetermined sequence of operation.

30. Apparatus for terminating a plurality of insulated conductors, according to claim 28, comprising:

a member pivotally carried by said carriage means pivotally mounting said insertion tool and pivoted by said programmer; and guide means for said insertion tool on said carriage to provide rectilinear transverse movement thereof as said member is pivoted.

31. In an apparatus of the type wherein a conductor terminating tool is carried by a pivotally mounted lever to press a conductor into a conductor receiving portion of an electrical contact, the tool including a cutting edge which is cooperable with a cutting edge of a cutting member disposed adjacent the contact to cut the conductor before the conductor is pressed into the conductor receiving portion of the contact, the improvement comprising:

means for converting the arcuate movement of the lever into a rectilinear movement of the tool, including a pivotal connection of the tool to the lever, a tool guide slidably mounting the tool for movement toward and away from the conductor receiving portion of the contact, and means carried by the tool for engaging the cutting member on an edge opposite its cutting edge to hold down the tool and prevent overriding and separation of the cutting edges due to engagement of a conductor.

32. Apparatus for terminating a plurality of insulated conductors in respective insulation-piercing contact portions supported on at least one side of an electrical connector, said apparatus comprising:

connector support means for supporting the connector with the contact portions oriented to receive respective conductors disposed immediately adjacent and parallel thereto;

movable means mounted for movement relative said connector support means to points spaced according to the spacing between the insulation-piercing contact portions;

an insertion tool mounted on said movable means for movement transverse to the relative movement of said movable means and including at least one insertion blade for engaging and pressing a conductor into an insulation-piercing contact portion; and an insertion programmer, said programmer including means defining the positions of said spaced points and means operable to effect relative movement between said movable means and said connector support means to said spaced points and movement of said insertion tool in accordance with a predetermined sequence of operation.

33. Apparatus for terminating a plurality of insulated conductors in respective insulation-piercing contact portions supported on at least one side of an electrical connector, said apparatus comprising:

connector support means for supporting the connector with the contact portions oriented to receive respect conductors disposed immediately adjacent and parallel thereto;

a carriage mounted for movement relative said connector support means between the points spaced a distance of at least a spacing between the insulation-piercing contact portions;

an insertion tool mounted on said carriage means for movement transverse to the relative movement of said carriage means and including at least one insertion blade for engaging and pressing a conductor into an insulation-piercing contact portion; and an insertion programmer, said programmer including means defining selected spaced points and means operable to effect relative movement to said selected spaced points between said carriage means and said support means and transverse movement of said insertion tool in accordance with a predetermined sequence of operation.

34. Apparatus for terminating a plurality of individual insulated conductors of a cable in respective insulation-piercing contact portions supported by an electrical device, the cable having at least a portion of each insulated conductor free to move, said apparatus comprising:

a cable clamp for holding the cable in a fixed position with the individual conductors free to be positioned immediately adjacent and parallel to respective contact portions;

support means for supporting the electrical device;

insertion means for inserting the insulated conductors into the insulation-piercing contact portions;

a frame mounting said insertion means and said support means for relative movement of said insertion means with respect to said cable clamp and support means to spaced points defined by the spacing of the contact portions, said insertion means including an insertion tool mounted for movement transverse to the direction of relative movement between said insertion means and said support means for engaging and pressing a conductor into an insulated-piercing contact portion; and insertion programming means, including means storing a predetermined sequence of relative positioning movement corresponding to selected spaced points and means operable to effect said relative movement to said selected spaced points and transverse movement of said insertion tool in accordance with a predetermined sequence of operation.

35. Apparatus for terminating a plurality of insulated conductors in respective insulation-piercing contact portions supported on at least one side of an electrical connector, said apparatus comprising:

connector support means for supporting the connector with the contact portions oriented to receive respective conductors disposed immediately adjacent and parallel thereto;

insertion means including indexable means for movement to spaced points defined by the distances between the insulation-piercing contact portions, and an insertion tool mounted for movement transverse to the movement of said indexable means for engaging and pressing a conductor into an insulation-piercing contact portion; and an insertion programmer including first means defining selected spaced points and second means coupled to said first means and operable to effect indexing of said indexable means to selected points and transverse movements of said insertion tool in accordance with a predetermined sequence of operation.

36. Apparatus for terminating a plurality of insulated conductors in respective insulation-piercing contact portions supported on at least one side of an electrical connector, said apparatus comprising:

connector support means for supporting the connector at a fixed location with the contact portions oriented to receive respective conductors disposed immediately adjacent and parallel thereto;

movable means mounted for movement with respect to said connector support means to points spaced according to the spacing between the insulation-piercing contact portions;

an insertion tool mounted on said movable means for movement toward and away from a supported connector transverse to the movement of said movable means and including at least one insertion blade for engaging and pressing a conductor into an insulation-piercing contact portion; and an insertion programmer, including a programming element defining selected spaced points and program controlled means connected to said programming element and operable to effect movement of said movable means with respect to said connector support means to said spaced points and transverse movements of said insertion tool in accordance with a predetermined sequence of operation.

37. Apparatus according to claim 36, wherein said insertion tool comprises a predetermined number of said insertion blades, and said insertion programmer includes means for indexing said movable means a number of said spaced points corresponding to said predetermined number for terminating a plurality of conductors at the same time.

38. Apparatus for terminating a plurality of insulated conductors in respective insulation-piercing contact portions supported in separate rows on each side of an electrical connector, said apparatus comprising:

connector support means for supporting the connector with the channels oriented to receive respective conductors disposed immediately adjacent and parallel thereto, including a support member and a cantilever member extending from said support member;

carriage means mounted for movement relative said cantilever support member, including a frame spanning said cantilever member;

a pair of insertion arms, each of said insertion arms mounted for movement on said frame on opposite sides of said cantilever member in alignment with each other;

a pair of conductor insertion tools each mounted on a respective insertion arm and each including at least one insertion blade for engaging and pressing a conductor into an insulation-piercing contact portion; and a control circuit including a device having extensible means connected to said insertion arms, first switch means operable to cause said extensible means of said device to move said insertion arms toward each other to effect conductor insertion, and second switch means operated by one of said arms upon completion of insertion to reverse said device and withdraw said extensible means.

39. Apparatus for terminating a plurality of insulated conductors in respective insulation-piercing contact portions supported on at least one side of an electrical device, said apparatus comprising:

support means for supporting the electrical device with the contact portions oriented to receive respective conductors disposed immediately adjacent and parallel thereto;

an insertion tool, said insertion tool and said support means mounted for movement, one relative the other, to positions spaced according to the spacing between the insulation-piercing contact portions of the electrical device, said insertion tool including at least one movably mounted insertion blade for engaging and pressing a conductor into an insulation-piercing contact portion; and an insertion programmer for controlling the relative positioning and the movement of said insertion blade, said programmer including program means defining selected relative positions of said insertion tool and device support means, start means operable to produce a start control, and sequence means connected to said program means, to said insertion tool and to said start means and responsive to the operation of said start means to control the relative positioning and the movement of said insertion blade in accordance with a predetermined sequence of operation.

40. Apparatus for terminating a plurality of insulated conductors in respective insulation-piercing contact portions supported on at least one side of an electrical device, said apparatus comprising:

support means for supporting the electrical device with the contact portions oriented to receive respective conductors disposed immediately adjacent and parallel thereto;

an insertion tool, said insertion tool and said support means mounted for movement, one relative the other, to positions spaced according to the spacing between the insulation-piercing contact portions of the electrical device, said insertion tool including at least one movably mounted insertion blade for engaging and pressing a conductor into an insulation-piercing contact portion; and an insertion programmer for operating the terminating apparatus through a predetermined sequence of operation including repetitive relative positionings of said support means and insertion tool and repetitive movements of said insertion blade, said programmer including program means defining selected relative positions of said insertion tool and device support means, and sequence means connected to said program means and to said insertion tool and operable to control the relative positioning and the movement of said insertion blade in accordance with the predetermined sequence of operation.

* * * * *